52-126.1
10/15/85 OF 4,546,580

United States Patent [19]

Ueno et al.

[11] Patent Number: 4,546,580

[45] Date of Patent: Oct. 15, 1985

[54] HEAT INSULATION STRUCTURE FOR ROOFTOPS OF BUILDINGS

[75] Inventors: Kazunori Ueno, Kodaira; Yohji Suizu, Koganei, both of Japan

[73] Assignee: Bridgestone Tire Co., Ltd., Tokyo, Japan

[21] Appl. No.: 512,966

[22] Filed: Jul. 12, 1983

[51] Int. Cl.[4] ..... E04D 15/00

[52] U.S. Cl. ..... 52/126.1; 52/126.5; 52/408

[58] Field of Search ..... 52/126.1, 126.5, 126.6, 52/126.7, 263, 408, 410, 506

[56] References Cited

U.S. PATENT DOCUMENTS

| | | | |
|---|---|---|---|
| 4,258,516 | 3/1981 | Mori et al. | 52/126.6 |
| 4,348,841 | 9/1982 | Ueno et al. | 52/126.5 |

FOREIGN PATENT DOCUMENTS

| | | | |
|---|---|---|---|
| 711847 | 6/1965 | Canada | 52/126.7 |
| 2447568 | 4/1976 | Fed. Rep. of Germany | 52/126.6 |
| 2742444 | 3/1979 | Fed. Rep. of Germany | 52/408 |
| 1577362 | 8/1969 | France | 52/126.1 |
| 490587 | 6/1970 | Switzerland | 52/126.6 |

*Primary Examiner*—J. Karl Bell
*Attorney, Agent, or Firm*—Darby & Darby

[57] ABSTRACT

A heat insulation structure for rooftops, coated with a waterproof layer, including: a plurality of heat insulation panels; a plurality of protective panels; and devices, supported on the waterproof layer, for supporting the insulation panels so that an air gap is formed between the waterproof layer and the insulation panels to form an air layer and for supporting the protective panels so that the protective panels are positioned above the insulation panels, the insulation panels being arranged in a side by side relation to thereby form an insulation layer, and the protective panels being arranged in a side by side relation to thereby form a protective layer.

7 Claims, 13 Drawing Figures

HEAT INSULATION STRUCTURE FOR ROOFTOPS OF BUILDINGS

BACKGROUND OF THE INVENTION

The present invention relates to a heat insulation structure for use in rooftops of buildings, particularly to a heat insulation structure for providing a heat insulation layer to the outside of flat roofs of concrete buildings and the like.

Recently, the exhaust of petroleum resources has become a real social problem, and thus it is now required to save energy which is consumed particularly in cooling and heating apparatus used in buildings. For this purpose various efforts have been made to improve heat insulation property of buildings by applying heat insulation treatments to them. It is advantageous to apply such heat insulation treatments to the roofs of buildings because the roofs are exposed to sunrays for a long period of time in summer and absorb heat, and because they are heated by heated air within the building and radiate heat in winter. The heat insulation treatments to the roofs of buildings, particularly concrete buildings include the so-called "outer heat insulation" treatment forming a heat insulation layer outside the roof and "inner heat insulation" treatment forming a heat insulation layer inside the roof. Particularly in concrete buildings, the "outer insulation" treatment is replacing the "inner insulation" treatment since the former provides a less heat load to roof slabs than the latter, and reduces the heat storage of the roof slabs in summer.

Generally, the "outer heat insulation" structure includes a waterproof layer disposed over the rooftop or the outer surface of the flat roof of a building, a heat insulation layer disposed over the waterproof layer, and a protective layer disposed over the heat insulation layer for protecting the latter. The heat insulation layer serves not only to provide heat insulation to the roof but also to prevent damages and heat deterioration of the water proof layer.

However, in such prior art outer heat insulation structure, the presence of the uppermost protective layer makes the maintenance of the underlying heat insulation layer and waterproof layer difficult. In most cases the protective layer is formed in place by wet construction method and thus the waterproof or heat insulation layer is liable to be damaged by trowels and the like. Furthermore, the protective layer which is formed by wet construction method is deteriorated by heat storage due to the underlying heat insulation layer and hence produces cracks which degrade the external appearance thereof. Rainwater enters through these cracks into the heat insulation layer, and hence the heat insulating material is often immersed in rainwater, so that it is deteriorated soon. It is therefore difficult to maintain the heat insulation property of the insulation layer for a long period of time.

SUMMARY OF THE INVENTION

Accordingly it is an object of the present invention to provide a heat insulation structure for use in the rooftops of buildings which structure prevents the heat insulation layer from being immersed in rainwater whereby the deterioration of the heat insulation material due to rainwater is greatly reduced and a longer life thereof is ensured.

It is another object of the present invention to provide a heat insulation structure for use in the rooftops of buildings which structure highly enhances the heat insulation property of the rooftops whereby energy consumed in cooling and heating apparatus used in the buildings is largely saved.

With these and other objects in view the present invention provides a heat insulation structure for rooftops, coated with a waterproof layer, of buildings, including: a plurality of heat insulation panels; a plurality of protective panels; and means, supported on the waterproof layer, for supporting the insulation panels so that an air gap is formed between the waterproof layer and the insulation panels to form an air layer, and for supporting the protective panels so that the protective panels are positioned above the insulation panels, the insulation panels being arranged in a side by side relation to thereby form an insulation layer, and the protective panels being arranged in a side by side relation to thereby form a protective layer.

BRIEF DESCRIPTION OF THE DRAWINGS

While the specification concludes with claims which particularly point out and distinctly define the subject matter which is regarded as the invention, it is believed the invention will be more clearly understood from the following detailed description and the accompaning drawings, in which:

DETAILED DESCRIPTION OF PREFERRED EMBODIMENTS

Figure 1:
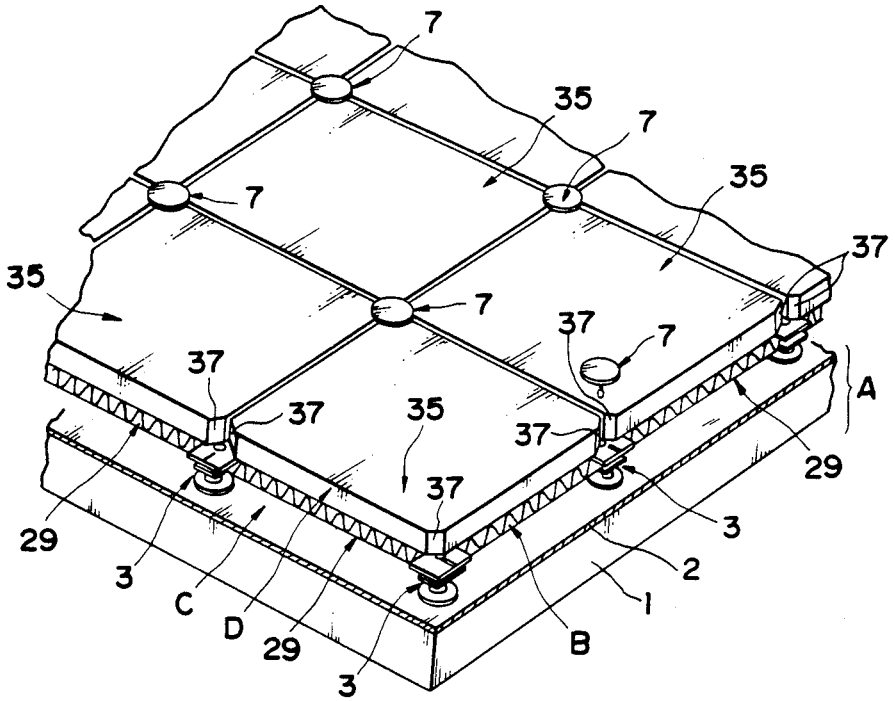
FIG. 1 is a fragmentary perspective view of a heat insulation structure according to the present invention.

Referring to FIG. 1, reference numeral 1 indicates a base of the flat roof of a concrete building. A waterproof layer 2 spreads over the outer surface of the base. The roof base 1 and the waterproof layer 2 constitute a waterproof flat roof A. On the outer surface of the waterproof layer 2 there is arranged in a predetermined interval a plurality of corner supporting devices 3 for supporting a heat insulation layer B and a protective layer D. The supporting devices 3 support the heat insulation layer B so that an air layer C is formed between the waterproof layer 2 and the insulation layer B and so that the protective layer D is positioned above the thermal insulation layer B.

Figure 3:
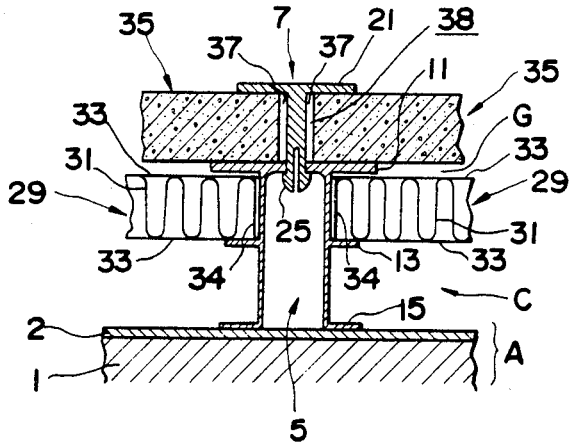
FIG. 3 is a vertical section of the supporting device in FIG. 2 in use.
Figure 2:
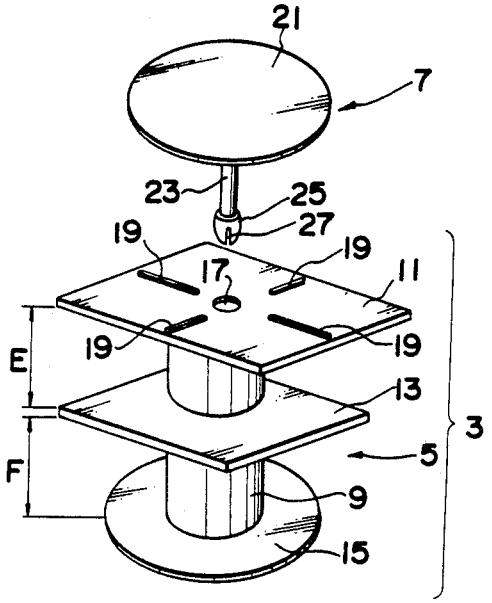
FIG. 2 is an exploded view of one embodiment of a corner supporting device used in the heat insulation structure in FIG. 1.

As shown in FIGS. 2 and 3, each corner supporting device 3 consists of a supporting member 5 and a securing member 7 engaging the latter. The supporting member 5 includes a hollow cylindrical supporting column 9, a first square flange or plate 11 integrally formed with the top end of the supporting column 9 to extend perpendicularly to the axis of the latter, a second square flange 13 projecting radially outwardly from the outer periphery of the column 9 to extend in parallel with the first frange 11 at a predetermined distance E, and a third flange 15 of a circular shape projecting radially outwardly from the bottom end of the supporting column 9. At the center of the first flange 11, there is formed a through hole 17, around which four ridges 19 are formed to radially extend at equal angular intervals of 90 . These ridges 19 are to place protective panels 35, which form the protective layer D, in position on the first flange 11, but they are not necessarily provided. The securing member 7 includes a securing disc 21 and a lock pin 23 projecting axially from the center of the disc 21. At the free end of the lock pin 23 there is integrally formed an enlarged portion 25 having an axial slot 27 axially formed through it for resiliently reducing its diameter by applying force to it. The lock pin 23 is fitted into the hole 17 by reducing the diameter of the enlarged portion 25 and then locked as shown in FIG. 3 by letting the enlarged portion to resiliently return back to its original shape. The above-described supporting member 5 and securing member 7 may be of any corrosion-resistant material such as stainless steel, brass, thermoplastics and the like.

The heat insulation layer B is formed by arranging a plurality of heat insulation panels 29 in columns and rows in a horizontal plane with their adjacent edges placed into abutment against each other. Each panel 29 is substantially of a square shape but may be of a rectangular or any other regular polygonal shape. The panel 29 preferably consists of a thermal insulation core 31 of a synthetic resin foam such as rigid urethane foam, styrene foam and the like and two face sheets 33 bonded to the opposite surfaces of the core 31 through adhesive. The face sheet 33 may be of any conventional material, and preferably a metal foil such as of aluminum and the like which is excellent in heat reflection and moisture-proofness and thus can enhance thermal insulation property of the panel 29. Instead of the metal foil a face sheet made of asphalt may be used. All the corners of each heat insulative panel 29 are chamfered at 34 as shown in FIG. 3.

The protective layer D is formed by arranging a plurality of protective panels 35 in columns and rows in another horizontal plane with their adjacent edges placed into abutment against each other. Each protective panel 35 is of a shape substantially congruent to that of the insulation panel 29 and is substantially of a square shape in this embodiment. The protective panel 35 may be of any conventional material, but must have a weight sufficient to withstand wind pressure exerted on the rooftop, and a strength sufficient to bear loads exerted by persons or articles which rest on it. The material for the protective panel 35 includes for example concrete, corrosion-resistant metal, plastic, FRP, rubber and the like. All the corners of each protective panel 35 are also chambered at 37 as clearly shown in FIG. 1.

In construction of the heat insulation structure on the waterproof roof floor A, first of all a single heat insulation panel 29 which constitutes one of the panels 29 of the heat insulation layer B is supported on four supporting members 5 placed on the waterproof roof floor A by positioning each corner thereof on the second flange 13 of the corresponding supporting member 5 as shown in FIG. 3. Then, a single protective panel 35 which constitutes one of the protective panels 35 of the protective layer D is supported on the four already located supporting members 5 by placing each corner thereof on the first flange 11 of the corresponding supporting member 5. Next, adjacent two corners of another or second insulation panel 29 are placed on the second flanges 13 of the two adjacent supporting members 5, and the other two corners thereof are placed in the same way on second flanges 13 of additional two supporting members 5. Another protective panel 35 which is to be placed above the second panel 29 is supported in the same way as the first protective panel 35 on the first flanges 11 of the above-mentioned two adjacent supporting members 5 and the additional two supporting member 5. By repeating such procedures, the four adjacent corners of four adjacent heat insulation panels 29 and those of four adjacent overlying protective panels 35 are placed on the first and second flanges 11 and 13 of supporting members 5, and thereby the insulation and protective layers B and D are formed over the waterproof roof floor A. In the protective layer D thus formed, openings 38 are, as shown in FIG. 3, defined by the chamfered corners 37 of the four adjacent protective panels 35, and the lock pin 23 of a securing member 7 is inserted through the opening 38 into the center hole 17 of each supporting member 5 by resiliently reducing the diameter of the enlarged portion 25 thereof, and then it is locked by allowing the enlarged portion 25 to return back to its original shape and to engage the periphery of the hole 17. Thus, the protective panels 35 are positively secured to each supporting device 3 and the heat insulation structure is completed as shown in FIG. 1.

In the above-described embodiment shown in FIG. 3, an additional air layer or gap G is formed between the heat insulation layer B and the protective layer D. The air gap G communicates to the ambient atmosphere through any clearances between adjacent protective panels 35 and gaps between the supported corners of protective panels 35 and the supporting portions of supporting devices 3, i.e., flange 11 and securing cap 7, and thereby protective panels 35 are prevented from being raised and flying about by a strong wind due to negative pressure generated around the upper faces of the protective panels 35. The use of a metal foil such as aluminum and the like as the face sheet 33 of the heat insulation panel 29 will improve thermal insulation of the air layer G due to reflection thereof. However, the heat insulation panel 29 and the protective panel 35 may be bonded together through adhesive to form an integral protective and thermally insulative layer. With respect to the thickness of each component of the thermal insulation structure according to the present invention, preferably the heat insulation layer B of synthetic resin foamed panels is about 10 to 50 mm, the protective layer D of concrete panels about 30 to 60 mm, and the air layer C about 10 to 80 mm for these insulative and protective layers B and D. These values depend on the materials used for the insulation layer B and the protective layer D.

In summer, sunrays which are projected onto the rooftop of a building provided with thermal insulation structure according to the present invention are received by the outer surface of the protective layer D, and the transference of the solar thermal energy to the waterproof rooftop A is prevented by the protective layer D, the heat insulation layer B, and the air layers C and G. On the other hand, in winter the outward thermal radiation from the base 1, which is heated by heating apparatus within rooms, is prevented by the above-described four layers. From these facts it will be clear that the heat insulation structure of the above-described embodiment can largely enhance thermal insulation of the rooftop, whereby the energy consumption in cooling and heating apparatus used in the building is greatly saved. Rainwater passes through the gap between adjacent protective panels 35, and then through the gap between adjacent insulative panels 29 to the waterproof layer 2. The heat insulation layer B is positioned above the waterproof layer 2 through the air layer C, so that it is prevented from contacting rainwater flowing over the waterproof layer 2, and thereby the possibility of the insulating layer C being deteriorated due to rainwater can be greatly reduced, and the sufficient heat insulation capacity of the insulating layer B can be ensured for a longer period of time. The construction of the protective layer D, the insulation layer B and the air layers C and G can be easily achieved by positioning the insulation panels 29 and the protective panels 35 on a plurality of the supporting devices 3. It is to be noted that a single supporting device 3 carries a plurality of the protective panels 35, four panels 35 in this embodiment. With this construction, the difference in level between the outermost protective panels 35 can be minimized and thereby the appearance can be improved. Furthermore, adjacent four protective panels 35 are held against the first flange 11 of the supporting member 5 by the securing member 7 which covers the four adjacent corners thereof as shown in FIG. 1, and thereby the difference in level between the panels 35 can be further reduced and the panels 35 can be prevented from disengaging from the supporting devices 3.

Figure 4:
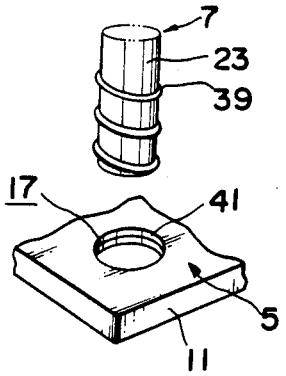
FIGS. 4 and 5 illustrate modified forms of the connection between a supporting member and a securing member of the supporting device in FIG. 2.

FIG. 4 illustrates a modification of the connection of the securing member 7 and the supporting member 5, in which a male screw 39 threaded on the lock pin 23 is threaded with a female screw 41 of the tapped hole 17 to thereby connect the securing member 7 to the supporting member 5.

Figure 5:
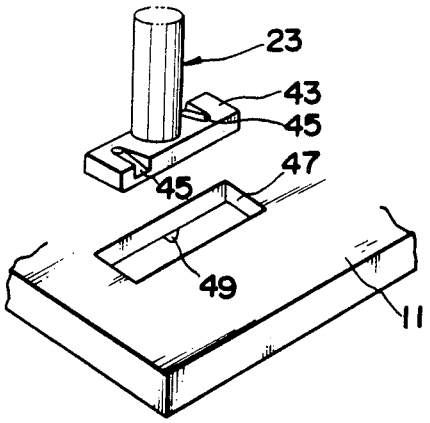

Another modification of the connection of the supporting member 5 and the locking member 7 is shown in FIG. 5. In this modification, with the distal end of the lock pin 23 there is integrally formed a rectangular latch 43 instead of the enlarged portion 25, the latch 43 having a pair of engaging grooves 45 formed symmertrically with respect to the lock pin 23 in the upper surface thereof. On the other hand, a corresponding rectangular through hole 47 instead of the circular hole 17 is formed in the first flange 11, from the lower surface of which a pair of projections 49, only one of which is shown, project downwards near the through hole 47. To engage the supporting member 5 and the securing member 7, the latch 43 is inserted through the hole 47 to the inside of the supporting column 9 and then rotated to bring the upper surface of latch 43 into engagement with the lower surface of the flange 11 and to fit projections 49 into the corresponding grooves 45, whereby the supporting member 5 and the securing member 7 are detachably locked. This and the preceding modifications of the detachable connection of the supporting member 5 and the securing member 7 can facilitate the removal of the protective panels 35 and the insulative panels 29 from the supporting device 3, whereby the maintenance of the waterproof layer 2 which lies below the protective layer D and the insulative layer B can be easily achieved.

Figure 6:
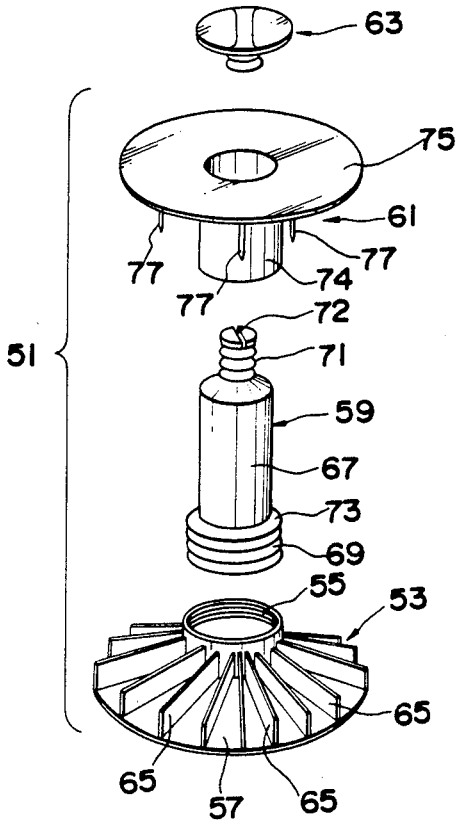
FIG. 6 is an exploded view of another embodiment of the supporting device.
Figure 7:
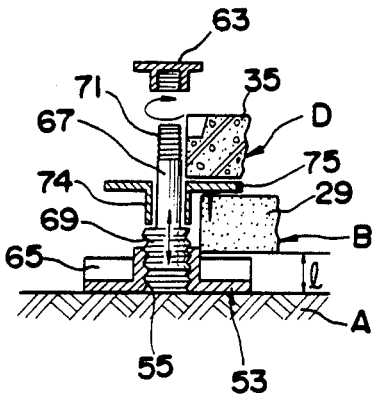
FIG. 7 is a scaled-down vertical section of the supporting device in FIG. 6 in use.

In FIGS. 6 and 7, there is shown another embodiment of the corner supporting device. The supporting device 51 generally includes a base seat 53 adapted to be positioned on the waterproof rooftop A, a shank 59 having bottom end threaded with the base seat 53, a fastening flange member 61 fitted loosely around the shank 59, and a cap 63 threaded with the top end of the shank 59. The base seat 53 includes a hub 55 and a circular flange 57 extending radially outwardly from the lower end of the hub 55. With the hub 55 and the flange 57 there are integrally formed a plurality of supporting plates 65 which extend radially in equal angular intervals. The shank 59 includes a cylindrical column portion 67, a first male screw 69 threaded on the bottom end of the column portion 67, the first male screw 69 threaded with the hub 55, and a second male screw 71 formed in the top end of the column portion 67. The first male screw 69 is formed to have a diameter larger than that of the column portion 67 and thereby a shoulder is formed at 73. The fastening flange member 61 includes a hub 74 and a circular flange 75 extending radially outwardly from the upper end of the hub 74. The hub 74 is fitted around the columnar portion 67 of the shank 59 and then the lower end thereof is carried by the shoulder 73 of the shank 59. From the lower surface of the flange 75 a plurality of fixing nails 77 which are welded to or integrally formed with the flange 75 project axially downwardly at equal angular intervals. However, fixing nails 77 are not necessarily provided.

With such construction of the supporting device 51, the base seat 53 is, as shown in FIG. 7, connected with the shank 59 by threading the hub 55 with the first screw 69, and then placed at a predetermined position on the waterproof rooftop A. One corner of each of the insulation panels 29 which are to be adjacently positioned is placed on the upper edges of the supporting plates 65 to form the heat insulation layer B. Then, the hub 74 of the fastening flange member 61 is inserted around the shank 59 and the flange portion 75 is depressed to thereby thrust the fixing nails into the insulation panels 29. Thereafter, on the flange portion 75 of the flange member 61 there is positioned one corner of each of the protective panels 35 so as to be adjacently placed, which is then cramped for forming a protective layer D by threading the cap 63 with the second screw 71 of the shank 59.

According to the second embodiment of the invention, the insulation layer B is positively positioned on the upper edges of the supporting plates 65 by the fixing nails 77 of the flange member 61, whereby the layer B is kept away from the waterproof rooftop A at a constant distance 1 and the positioning of the heat insulative panels can be easily achieved. By removing the cap 63 from the male screw 71 and then rotating with respect to the base seat 53 the shank 59 by a suitable tool such as screw drive which is fitted in a slot 72 formed at the top of the second male screw 71, the shank 59 and the flange member 61 fitted around the latter can be raised or lowered and thereby the level of the protective layer D can be easily adjusted after it is formed. Furthermore, only desired panels of the heat insulation layer B and the protective layer D can be removed in the order reverse to the order of the forming of the layers B and D, and thus the maintenance of the waterproof layer A or insulation layer B can be easily made without disassembling the whole panels, which reduces the maintenance cost and labor.

Figure 8:
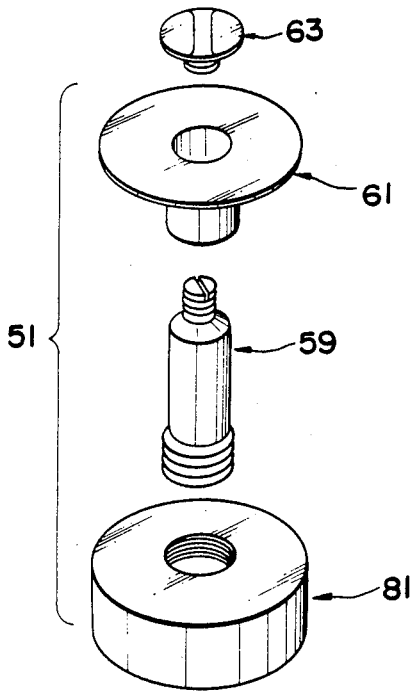
FIG. 8 is an exploded view of a modified form of the supporting device in FIG. 6.
Figure 9:
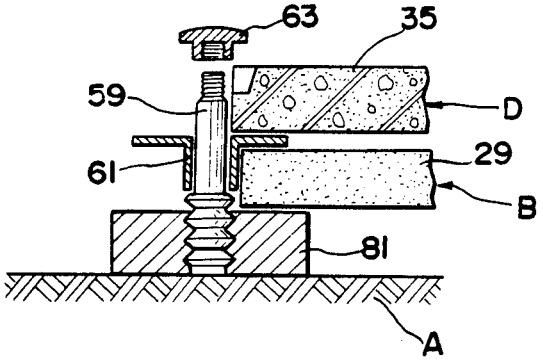
FIG. 9 a scaled-down vertical section of the supporting device in FIG. 8 in use.

Referring to FIGS. 8 and 9, there is illustrated a modified form of the supporting device 51 in FIGS. 6 and 7, in which a solid cylindrical base seat 81 is adopted in place of the base seat 53 having radial support plates 65 formed thereon. The insulation panels 29 are supported on the top surface of the base seat 81. Further, the flange member 61 of this modification is provided with no nails 77.

Figure 10:
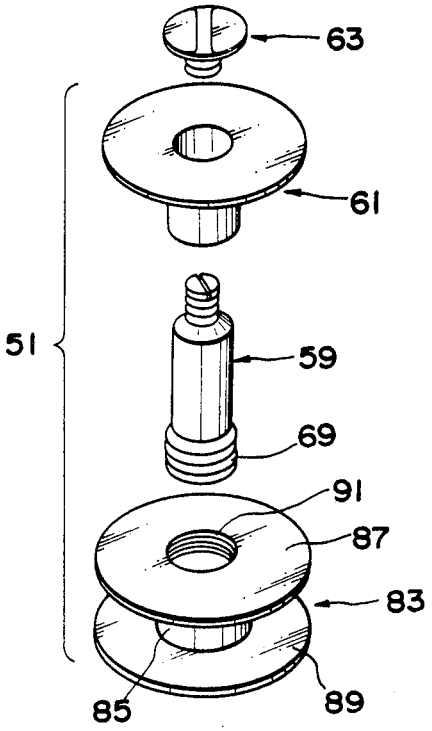
FIG. 10 is an exploded view of another modification of the supporting in FIG. 6.
Figure 11:
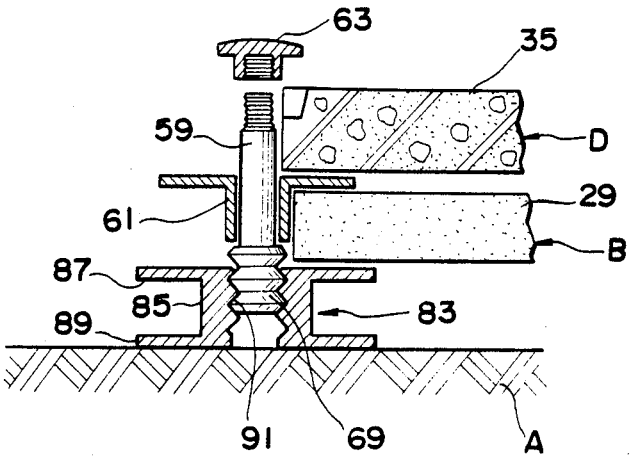
FIG. 11 is a scaled-down vertical section of the supporting device in FIG. 10 in use.

In FIGS. 10 and 11, there is illustrated a further modified form of the supporting device 51 which includes a spool-shaped base seat 83. The base seat 83 comprises a hollow cylindrical portion 85, and a pair of upper and lower flanges 87 and 89 extending radially outwardly from the upper and lower ends of the cylindrical portion 85 respectively. The first male screw 69 of the shank 59 threaded with a tapped inner surface 91 of the cylindrical portion 85. The panels 29 of the insulation layer B are placed on the upper surface of the upper flange 87 as shown in FIG. 11.

Figure 13:
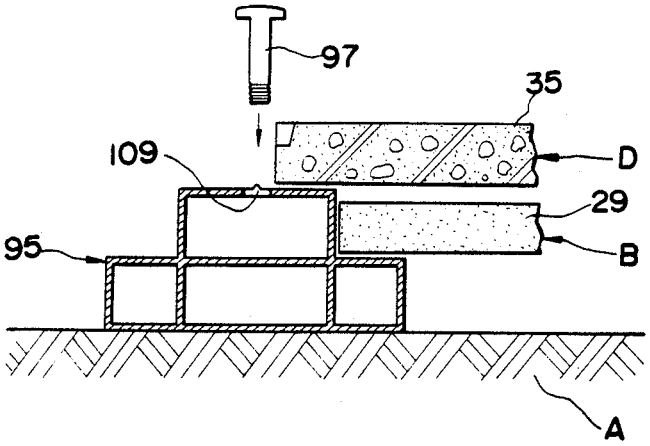
FIG. 13 is a scaled-down vertical section of the supporting device in FIG. 12.
Figure 12:
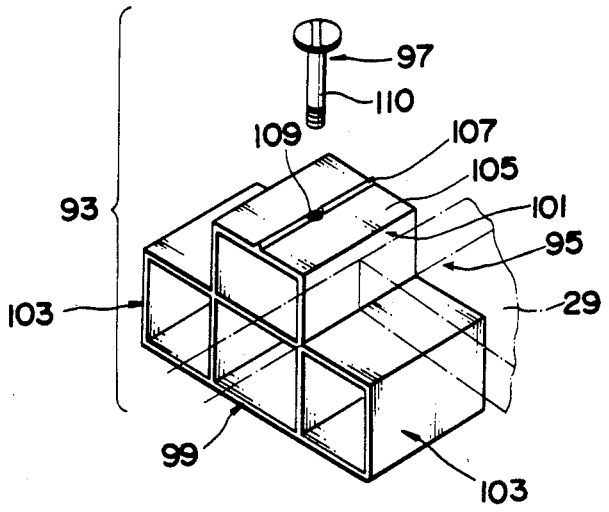
FIG. 12 is a perspective view of still another embodiment of the supporting device used in the present invention.

FIGS. 12 and 13 show another embodiment of the present invention, in which the corner supporting device 93 includes a generally inverted-T-shaped supporting base 95 formed of for example thermoplastic material by profile extrusion moulding and a tap bolt 97. The supporting base 95 includes a center cell 99, an upper cell 101 integrally formed above the center cell 99, and a pair of side cells 103 integrally formed with the opposite sides of the center cell 99. These cells 99, 101, and 103 are of rectangular tube shape. A ridge 107 of a triangular profile is longitudinally and centrally formed on the upper wall of the upper cell 101. In the center of the upper wall of the upper cell 101, there is formed a tapped hole 109 through the ridge 107, with which hole 109 the threaded distal end of a shank 110 of the tap bolt 97 engages. In this embodiment, as shown in FIG. 12 by a phantom line, two of the four adjacent heat insulation panels 29 are each supported on one of the side cells 103 by placing one corner thereof on the top face of the one cell 103 with one edge thereof placed into abutment against that of the other panel 29. The other two adjacent insulation panels 29 are positioned on the other side cell 103 likewise. Then, the corners of four adjacent protective panels 35 are positioned on the top face of the upper cell 101 in a manner substantially desdribed in the preceding embodiments to form the protective layer D. The protective panels thus positioned are positively fastened to the upper cell 101 by threading the tap bolt 97 with the hole 109. The supporting device 93 can be manufactured at lower cost than the other supporting devices 3 and 51, although the level of the protective layer D cannot be adjusted.

Although all the preceding embodiments of the present invention, the supporting devices 3, 51, and 93 are not fixedly attached to but merely placed on the waterproof layer 2 of the rooftop, they may be fixedly attached to the rooftop by bonding the bottom flange 15, 57 and 87 of the base seat 5, 53 and 81 to the waterproof layer 2 through adhesive. By such bonding, the supporting device can be positively prevented from being separated from the waterproof layer 2 due to the force of wind exerted thereon even if light-weight thin protective panels are used. The use of light-weight protective panels will facilitate the forming of the protective layer D and furthermore make the load exerted on the roof base 1 less heavy, which can lessen the strength of not only the roof slab 1 but also the building, resulting in the reduction in the cost of the building.

While the invention has been disclosed in specific detail for purposes of clarity and complete disclosure, the appended claims are intended to include within their meaning all modifications and changes that come within the true scope of the invention.

What is claimed is:

1. A heat insulation structure for a building rooftop, said rooftop being coated with a waterproof layer, comprising:

a plurality of heat insulation panels;

a plurality of protective panels; and supporting means supported on said waterproof layer, for supporting said heat insulation panels so that a first air gap is formed between said waterproof layer and said insulation panels to form a first air layer, said supporting means also supporting said protective panels so that said protective panels are positioned above said insulation panels so that a second air layer is formed between said insulation panels and said protective panels, said insulation panels being arranged in a side by side relation to thereby form an insulation layer, and said protective panels being arranged in a side by side relation to thereby form a protective layer,

2. A heat insulation structure as recited in claim 1, wherein said supporting means includes a corner supporting device, said corner supporting device comprising:

a center member, a first supporting member attached to said center member for supporting corners of adjacent protective panels, and a second supporting member attached to said center member so as to be disposed below said first supporting member for supporting corners of adjacent heat insulation panels.

3. A heat insulation structure as recited in claim 2, wherein said corner supporting device further includes a securing member connected to said center member, for holding said corners of said adjacent protective panels against said first supporting member.

4. A heat insulation structure as recited in claim 3, wherein said center member is a supporting column vertically supported on the waterproof layer, said first and second supporting members are first and second flanges projecting radially outwardly from said supporting column respectively, and said securing member includes a securing plate and a pin projecting perpendicularly from said securing plate and engaging with a top portion of said supporting columm.

5. A heat insulation structure as recited in claim 3, wherein:

said center member is a shank, said second supporting member is a base seat supported on said waterproof layer and threadedly engages a bottom end of said shank, said first supporting member is a flange member fitted around and supported on said shank so that said flange member is positioned at a predetermined level above said base seat, said flange member receiving at its upper face said corners of said adjacent protective panels, and said securing member is a cap threadedly engaged with a top end of said shank.

6. A heat insulation structure as recited in claim 3, wherein said center member is a center rectangular column member, said first supporting member is a first rectangular column member integrally formed above said center member, said second supporting member is a second rectangular column member integrally formed with each side of said center member, and said securing member is a bolt member threadedly engaged with the top face of said first member.

7. A heat insulation structure as recited in claim 5, wherein:

said shank comprises an upper threaded portion for engaging with said cap, and a lower threaded portion, said shank having a slot at its top end;

said flange member comprises a first hub portion, and a first flange portion extending radially outwards from the first hub portion, said first hub portion fitted around said shank and resting at a lower end of said first hub portion on an upper portion of said lower threaded portion of said shank; and said base seat comprises a second hub portion, a second flange portion extending radially outwardly from a lower end of said second hub portion, said second flange portion being placed on said waterproof layer, and a plurality of supporting plates integrally and vertically formed with the outer periphery of said second hub portion and an upper face of said second flange portion at angular intervals so that a supporting edge is formed by an upper edge of each supporting plate for supporting said corners of said insulation panels, said second hub portion being threadedly engaged with said lower threaded portion of said shank.

* * * * *